United States Patent [19]

Spranger

[11] Patent Number: 4,481,663

[45] Date of Patent: Nov. 6, 1984

[54] NETWORK FOR USE WITH PIEZOCERAMIC TRANSDUCER

[75] Inventor: Paul B. Spranger, Fullerton, Calif.

[73] Assignee: Altec Corporation, Anaheim, Calif.

[21] Appl. No.: 494,137

[22] Filed: May 16, 1983

Related U.S. Application Data

[63] Continuation of Ser. No. 196,037, Oct. 10, 1980, abandoned.

[51] Int. Cl.[3] ..... H04R 3/00

[52] U.S. Cl. ..... 381/98; 179/110 A; 333/177; 381/116

[58] Field of Search ..... 381/98, 116; 179/110 A; 336/69, 148; 328/239; 333/131, 175, 177

[56] References Cited

U.S. PATENT DOCUMENTS

| | | | |
|---|---|---|---|
| 1,907,723 | 5/1933 | Bostwick | 381/99 |
| 3,262,075 | 7/1966 | Podell | 336/148 |
| 4,237,340 | 12/1980 | Klipsch | 381/99 |

FOREIGN PATENT DOCUMENTS 564460 9/1944 United Kingdom .

OTHER PUBLICATIONS

H. Tremaine, *Audio Cyclopeda,* Mar. 1977, Howard W. Sams & Co., Inc., pp. 353 and 368.

*Primary Examiner*—Gene Z. Rubinson
*Assistant Examiner*—Randall P. Myers
*Attorney, Agent, or Firm*—Edward A. Sokolski

[57] ABSTRACT

A network for matching an electrical source of audio signals to a piezoceramic driver for a high frequency loudspeaker. The network consists of all of the elements of a bandpass filter network, but with the parallel combination of an inductor and a capacitor in the output stage of the filter replaced by an autotransformer or autoinductor which transforms the input impedance of the piezoceramic transducer into an equivalent parallel capacitance and resistance which, together with the inductance of the autotransformer, supply the load resistance for the filter and replace the capacitor and inductor omitted from the output stage of the bandpass network. An additional shunt resistor may be placed across the output of the autotransformer to obtain the desired effective load resistance at the input of the autotransformer.

13 Claims, 5 Drawing Figures

NETWORK FOR USE WITH PIEZOCERAMIC TRANSDUCER

This application is a continuation of U.S. Pat. Ser. No. 196,037 filed Oct. 10, 1980, now abandoned.

BACKGROUND OF THE INVENTION

1. Field of the Invention

This invention pertains to loudspeakers. More particularly, it pertains to networks for connecting sources of audio frequency electrical signals to loudspeaker drivers in a manner which compensates for certain undesirable characteristics of the drivers.

2. Description of the Prior Art

Piezoceramic high-frequency drivers for loudspeakers typically exhibit an input impedance which is approximately equivalent to the parallel combination of a capacitor and a resistor. The resistive component of the input impedance is usually greater than 100 ohms, which is relatively large compared to the 4 to 8 ohms that is the typical input impedance of a moving coil, loudspeaker driver. As a consequence, if the piezoceramic driver for a high-frequency loudspeaker is connected directly in parallel with a lower frequency, moving-coil loudspeaker, the high frequency transducer produces a relatively low output at the higher frequencies as compared to the audio signal output of the moving-coil loudspeaker at the lower audio frequencies. The difference in the relative outputs of the two speakers produces an undesired unbalance in the spectrum of audio frequencies produced by the speaker system.

A further undesirable property of the piezoceramic driver is that the capacitive component of the input impedance of the piezoceramic transducer "loads down" the output of the signal generator or amplifier at the higher frequencies where the reactance of the capacitor is relatively low. Also, the capacitor's reactive characteristic may produce sufficient phase angle to the current supplied by the amplifier to cause the amplifier to become unstable.

SUMMARY OF THE INVENTION

This invention is a network of electrical components which, in cooperation with the transducer, operate as a bandpass network to allow electrical energy to be transferred from the signal generator or source of electrical energy at audio frequencies to the output of the loudspeaker over a range of operation determined by the pass band of the filter. The network transfers the energy in a relatively uniform manner over those frequencies within the pass band. In addition, the network transforms the resistive component of the input impedance of the transducer to a lower value, such that a greater portion of the audio energy available from the signal generator and within the pass band of the filter is transformed by the transducer into audio sound waves at the output of the piezoceramic loudspeaker.

DESCRIPTION OF THE PREFERRED EMBODIMENT

Figure 1:
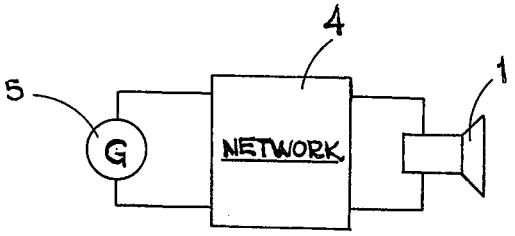
FIG. 1 is a block diagram showing the connection of the invention between a loudspeaker driver and a source of audio frequency electrical energy.
Figure 2:
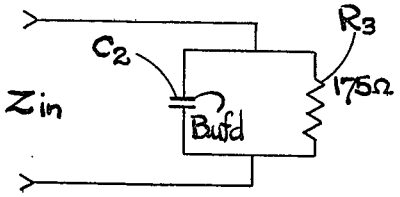
FIG. 2 shows the equivalent circuit for the transducer.

Referring now to FIG. 1, the network 4 of this invention is used to connect piezoceramic transducer 1, which is the driver for a high frequency loudspeaker, to generator 5, which is a source of electrical energy at audio frequencies. FIG. 2 contains the schematic diagram of an equivalent circuit for a typical piezoceramic transducer, such as transducer 1 depicted in FIG. 1. Over a wide range of frequencies, the input impedance to piezoceramic transducer 1 can be represented by the parallel combination of the transducer capacitor 2 and the transducer resistor 3 shown in FIG. 2. A typical value for the transducer capacitor 2 is 0.3 microfarads and a typical value for the transducer resistor 3 is 175 ohms.

This invention is based on an adaptation of a bandpass network, such as a constant K or M-derived type of bandpass network, or a "modern" bandpass network such as a Butterworth, Tschebyscheff or flat time delay (Bessel polynomials) type of network, all of which are well-known in the art. The invention is based on any of the filters of this general type having two or more "poles" that have an output stage consisting of a parallel combination of an inductor and a capacitor. The inductor and capacitor in the output stage of the filter, together with the load resistor into which the filter is designed to operate, are replaced in this invention by an autotransformer which is connected to the piezoceramic transducer. In some cases, a shunting resistor is also connected across the transducer.

Figure 3:
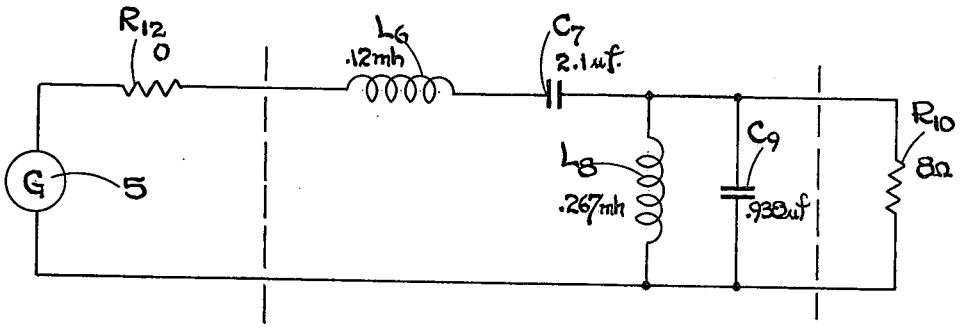
FIG. 3 is a schematic diagram of a two-pole Butterworth filter.

FIG. 3 contains an example of a two-pole Butterworth bandpass filter which is designed to operate with an 8-ohm load resistor and a voltage generator having zero internal impedance. The series inductor L6 of 0.12 millihenrys inductance and the series capacitor C7 of 2.1 microfarads capacitance, together with the parallel combination of inductor L8 of 0.267 millihenry inductance and capacitor C9 having a capacitance of 0.938 microfarad, operate as a bandpass filter when connected between load resistor R10 of 8 ohms resistance and generator 5 which has an internal resistance R12 of zero. The bandpass filter in this example has a high frequency cutoff, or −3 db point, at 20 kHz, and a low frequency cutoff at 5 kHz.

Figure 4:
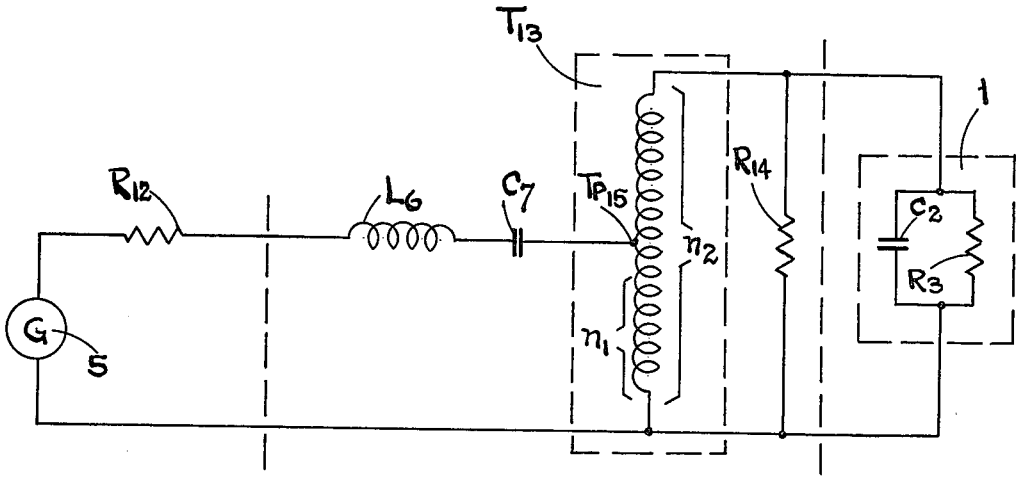
FIG. 4 is a schematic diagram of an example of the invention connected between a transducer and a generator.

In this invention, the parallel combination of inductor L8 and capacitor C9 in the output stage of the filter and the load resistor R10 are replaced by an autotransformer that is connected to piezoceramic transducer 1 to which also may be added a shunt resistor across the transducer. Referring now to FIG. 4, inductor L8, capacitor C9 and resistor R10 of FIG. 3 have been replaced in FIG. 4 by autotransformer T13, shunt resistor R14 and piezoceramic transducer 1, which transducer is represented in FIG. 4 by its equivalent circuit; that is, by the parallel combination of capacitor C2 and resistor R3.

In the preferred embodiment, for best performance, autotransformer T13 consists of a number of turns of wire, wound on a magnetic core, which core may be in the shape of a toroid, a pot-core, an E-core, or other suitable shape, such that nearly all of the magnetic flux generated by the winding passes through all of the turns of the autotransformer, thus providing a low or negligible short circuit reactance for the autotransformer. The autotransformer is connected as shown in FIG. 4, with intermediate tap TP15 connected to capacitor C7. The autotransformer is selected such that the input impedance between the ground or common connection of the autotransformer and the input at tap TP15 is equal to the value of inductor L8 (0.267 millihenrys) when the output of the autotransformer is open circuited.

The turns ratio of the number of windings in the input and output of the autotransformer, that is N2/N1, is selected so as to transform the value of transducer capacitor C2 (0.3 $\mu$Fd) at the input tap of autotransformer T13, to a value equal to capacitor C9, that is to 0.938 microfarads. Thus, in the example, the ratio of N2/N1 is given by $$\frac{N2^2}{N1^2} = \frac{C9}{C2} = \frac{.9308}{.3} = 3.13$$

or $$\frac{N2}{N1} = \sqrt{3.13} = 1.77.$$

In order for the combination of the shunt resistor R14 and the transducer resistor R3 to be transformed by the autotransformer T13 into a load resistor of 8 ohms; that is, to appear equivalent to the load resistor R10 of 8 ohms, resistor R14 in parallel with resistor R3 must be equal to an amount given by $$R14 \parallel R3 = R10 \times \frac{N2^2}{N1^2} = 8 \times 3.13 = 25 \text{ ohms.}$$

The value of the shunt resistor, R14, accordingly is given by $$R14 = \frac{R3 \times 25}{R3 - 25} = \frac{175 \times 25}{175 - 25} = 29 \text{ ohms.}$$

Because of the autotransformer action, the requirement that the open circuit inductance at the input of autotransformer T13 be 0.267 millihenrys can also be considered to be the requirement that the open circuit inductance of the autotransformer be 0.835 millihenrys when viewed at the output terminals.

Thus, by appropriate choice of the autotransformer, its open circuit inductance, its turns ratio and the shunt resistor R14, the input impedance to the autotransformer, when connected to transducer 1, can be made to appear the same as the parallel combination of capacitor C9 and inductor L8 in the output stage of the filter and the load resistor R10.

In some cases, a shunt resistor will not be necessary if the load resistance for which the filter is designed, is approximately equal to the effective value of the transducer resistance after transformation by the autotransformer.

Figure 5:
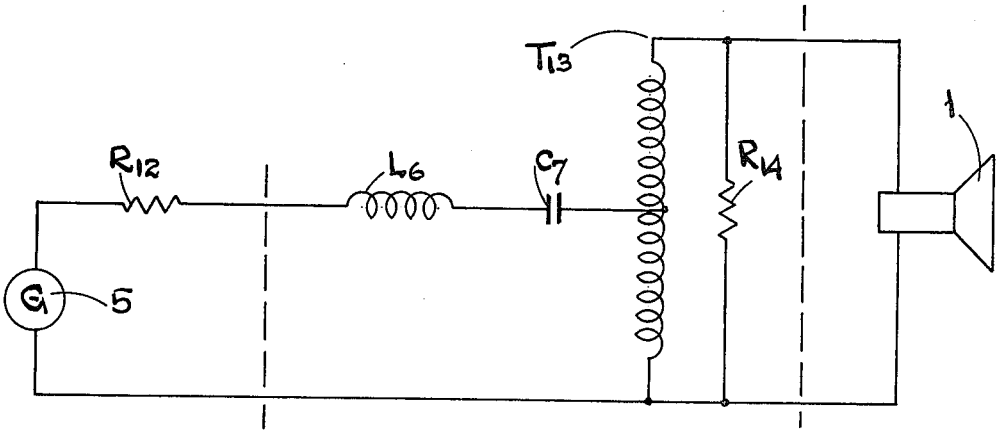
FIG. 5 also is a schematic diagram of an example of the invention connected between a transducer and a generator.

Referring now to FIG. 5, the preferred embodiment, for the example of this invention given above, is the series combination of inductor L6 and capacitor C7 connected to autotransformer T13 having a turns ratio N2/N1 of 1.77 and an open circuit reactance as viewed from the output of autotransformer T13 of 0.84 millihenry, the output of which transformer is connected to piezoceramic transducer 1 and to shunt resistor R14 having a resistance of 29 ohms.

Autotransformer T13, of course, could be replaced by a two-winding transformer having a small short circuit input inductance and having an open circuit input inductance equivalent to an inductance of 0.267 millihenrys. It also should be apparent that the division of the power delivered to shunt resistor R14 and to transducer 1 can be altered by adding a shunt capacitance across transducer 1 and adjusting the other circuit parameters accordingly.

The autotransformer could also be described or characterized as an "auto inductor" since it is designed not only to transform impedances connected at its output, but also to exhibit a specified inductance at its input when the output is open circuited. To accurately control the open circuit inductance of the autotransformer, the magnetic-core of the autotransformer in the preferred embodiment will contain an air-gap.

It further should be apparent that the network of this invention is not limited to a network based on the two-pole Butterworth bandpass network shown in the example. Networks with a higher number of "poles", e.g. 3, 4, 5 or 6 or more poles, can be used as the basis for this invention, the only requirement being that the output stage of the filter consist of the parallel combination of an inductor and a capacitor, which capacitor and inductor together with the load resistor for the filter can be replaced by an autotransformer and a shunt resistor connected to the piezoceramic transducer.

If the invention is to be used with a voltage source, then the input stage of the filter, upon which the network of this invention is based, should consist of a series combination of an inductor and a capacitor, such as that shown in FIG. 3. If the generator is a current source, then the input stage of the network should be a parallel combination of an inductor and a capacitor. For a generator which has a finite internal resistance, a filter with either a series or parallel input may be used as the basis for the network of this invention.

The network of this invention operates as a bandpass filter to transfer electrical energy to the transducer over a desired range of frequencies. It also operates to cause the transducer to operate in a relatively uniform manner over the pass band. The network further operates to transform the equivalent input resistance of the transducer to a lower value to match the design impedance of the amplifier so that a greater amount of electrical energy from the generator or amplifier will be transferred to the transducer over the range of frequencies within the passband of the filter.

I claim:

1. An electrical network for coupling an electrical source of audio frequency energy to an acoustic transducer, said transducer having an electrical input impedance over a frequency range which is approximately equivalent to the impedance of the parallel combination of a transducer capacitor and a transducer resistor, comprising:

a truncated filter circuit having an input and an output, with its input connected to the electrical source of audio frequency energy and its output connected to said transducer, said truncated filter circuit comprising at least a first filter branch having filter elements connected between said input and output and a second filter branch having autotransformer output means connected to the output of said first filter branch and connected across said transducer, said truncated filter circuit cooperating with said transducer capacitor to operate as a bandpass filter having a design impedance, whereby said autotransformer output means and said transducer capacitor provide an impedance equivalent to the impedance provided by a parallel combination of an output capacitor and an output inductor of any bandpass filter having such a parallel combination of said output capacitor and said output inductor in the output stage of said bandpass filter, said truncated filter circuit further cooperating with said acoustic transducer to operate as the combination of a bandpass filter having two or more poles and an acoustic transducer.

2. The network described in claim 15, and further comprising a shunt resistor connected across the output of the autotransformer output means, the equivalent resistance at the input of the autotransformer output means of the parallel combination of the shunt resistor and the transducer resistor being approximately equal to the design impedance of the bandpass filter.

3. The network described in claim 1 or 2 wherein the truncated filter circuit comprises a direct electrical connection from one side of the input to one side of the output of the truncated filter circuit and a series combination of a filter inductor and a filter capacitor, forming said first filter branch, connected from the other side of the input to the other side of the output of the truncated filter circuit.

4. The network described in claim 2 wherein said truncated filter circuit cooperates with said acoustic transducer to operate as the combination of a constant K bandpass filter and an acoustic transducer.

5. The network described in claim 2 wherein said truncated filter circuit cooperates with said acoustic transducer to operate as the combination of an M-derived bandpass filter and an acoustic transducer.

6. The network described in clain 2 wherein said truncated filter circuit cooperates with said acoustic transducer to operate as the combination of a Butterworth bandpass filter and an acoustic transducer

7. The network described in claim 2 wherein said truncated filter circuit cooperates with said acoustic transducer to operate as the combination of a Tschebyscheff bandpass filter and an acoustic transducer.

8. The network described in claim 2 wherein said truncated filter circuit cooperates with said acoustic transducer to operate as the combination of a flat time delay-Bessel polynomial bandpass filter and an acoustic transducer.

9. The network described in claim 1 wherein said truncated filter circuit cooperates with said acoustic transducer to operate as the combination of a constant K bandpass filter and an acoustic transducer.

10. The network described in claim 1 wherein said truncated filter circuit cooperates with said acoustic transducer to operate as the combination of an M-derived bandpass filter and an acoustic transducer

11. The network described in claim 1 wherein said truncated filter circuit cooperates with said acoustic transducer to operate as the combination of a Butterworth bandpass filter and an acoustic transducer.

12. The network described in claim 1 wherein said truncated filter circuit cooperates with said acoustic transducer to operate as the combination of a Tschebyscheff bandpass filter and an acoustic transducer.

13. The network described in claim 1 wherein said truncated filter circuit cooperates with said acoustic transducer to operate as the combination of a flat time delay-Bessel polynomial bandpass filter and an acoustic transducer.

* * * * *